US007452227B2

(12) United States Patent
Matoba et al.

(10) Patent No.: US 7,452,227 B2
(45) Date of Patent: Nov. 18, 2008

(54) CONNECTOR

(75) Inventors: Masato Matoba, Kawasaki (JP); Atsushi Yokoigawa, Okayama (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 12/047,785

(22) Filed: Mar. 13, 2008

(65) Prior Publication Data

US 2008/0233781 A1 Sep. 25, 2008

(30) Foreign Application Priority Data

Mar. 19, 2007 (JP) ..... 2007-069899

(51) Int. Cl.
*H01R 13/15* (2006.01)

(52) U.S. Cl. ..... 439/260; 439/495

(58) Field of Classification Search ..... 439/260, 439/494, 495, 733.1

See application file for complete search history.

(56) References Cited

U.S. PATENT DOCUMENTS 7,258,561 B2 * 8/2007 Fukazawa ..... 439/260
7,300,304 B1 * 11/2007 Takashita ..... 439/260

FOREIGN PATENT DOCUMENTS

JP 2004-071160 A 3/2004
JP 2004-342426 A 12/2004

OTHER PUBLICATIONS

English abstract of JP2004342426 published Dec. 2, 2004, esp@cenet database, 1 page.
English abstract of JP2004071160 published Mar. 4, 2004, esp@cenet database, 1 page.

* cited by examiner

*Primary Examiner*—Tho D Ta
(74) *Attorney, Agent, or Firm*—Osha•Liang LLP

(57) ABSTRACT

A connector has a base having insertion holes in parallel at a predetermined pitch, A connector has a base having insertion holes in parallel at a predetermined pitch, H-shape connecting terminals laterally inserted into the insertion holes, each connecting terminal having a support contact piece on a lower side of the connecting terminal, a manipulation contact piece on an upper side of the connecting terminal, and a coupling portion which couples the support contact piece and the manipulation piece, and a manipulation lever rotatably attached to a bearing portion of the support contact piece disposed on a first side of the base. A latching pawl, formed on a first end of the support contact piece, is latched on an edge portion of the base. A flexible board is inserted from an opening on a second side of the base. The manipulation lever manipulates the manipulation contact piece to bring an end portion of the manipulation contact piece into pressure-contact with the flexible board.

12 Claims, 10 Drawing Sheets

CONNECTOR

BACKGROUND OF THE INVENTION

1. Field of the Invention

The present invention relates to a connector, particularly to a connector connected to a connecting portion provided in parallel in a front-end portion of a flexible printed circuit board (hereinafter referred to as "FPC").

2. Description of the Related Art

Conventionally, for example, Japanese Patent Application Laid-Open No. 2004-342426 discloses a connector As shown in FIG. 6C of Japanese Patent Application Laid-Open No. 2004-342426, a fitting portion 23c located on one end side of a lower arm portion 23 is engaged with an edge portion on one side of a main body portion 31, the other end portion of the lower arm portion 23 is inserted in an insertion hole 32 of the main body portion 31, and only an upper arm portion 21 is rotatably supported.

However, in the connector mentioned above, when the other end portion of the lower arm portion 23 is used as a contact, the lower arm portion 23 cannot follow FPC to be elastically deformed even if an inadvertent drawing force is applied to FPC (not shown). Therefore, in the connector, there is a risk of generating contact failure between FPC and the lower arm portion 23. Additionally, in the connector, it is necessary to make the insertion hole 32 in the main body portion 31 to insert the other end portion of the lower arm portion 23, which hardly achieves miniaturization in a width direction of the main body portion 31. Particularly, because large bending moment acts on the vicinity of the insertion hole 32, it is necessary to increase rigidity around the insertion hole 32. Therefore, it is necessary that the surroundings of the insertion hole 32 be made of a thick resin, which hardly achieves the low-profile connector.

In order to solve the decrease in contact reliability, for example, Japanese Patent Application Laid-Open No. 2004-71160 discloses a connector. As shown in FIGS. 2 and 4 of Japanese Patent Application Laid-Open No. 2004-71160, a contact 14 is inserted in a base 12, and contacting portions 22 and 22 are supported so as to be able to follow FPC 40.

However, in the connector disclosed in Japanese Patent Application Laid-Open No. 2004-71160, only a fixing portion 42 shown in FIG. 4 is provided to prevent drop-out. Therefore, unfortunately variations in assembly accuracy are easily generated to hardly obtain the connector having uniform operating characteristics.

SUMMARY OF THE INVENTION

In one or more embodiments of the invention, a low profile connecter has a connecter having high contact reliability, small floor area, and uniform operating characteristics.

In one or more embodiments of the invention, a connector in which H-shape connecting terminals including support contact pieces and manipulation contact pieces are laterally inserted in insertion holes of a base, the insertion holes being made in parallel at predetermined pitches, the support contact piece and the manipulation contact piece being coupled by a coupling portion, a latching pawl is latched in an edge portion of the base, the latching pawl being formed in the other end portion of the support contact piece located on a lower side of the connecting terminal, a flexible board is inserted from an opening on one side of the base, a manipulation lever rotatably attached to a bearing portion of the support contact piece disposed on the other side of the base is manipulated to manipulate the other end portion of the manipulation contact piece formed on an upper side of the connecting terminal, and thereby bringing one end portion of the manipulation contact piece into pressure-contact with the flexible board, wherein at least one bending portion is formed in the support contact piece of the connecting terminal so as to be laterally projected toward a direction orthogonal to an insertion direction, and only upper-end and lower-end surfaces of the bending portion are brought into pressure-contact with and supported by upper and lower surfaces of the insertion hole.

According to one or more embodiments of the invention, because one end portion of the support contact piece located on the lower side of the connecting terminal constitutes a free end, one end portion of the manipulation contact piece and one end portion of the support contact piece can elastically be deformed to improve the following capability for FPC. As a result, even if the inadvertent drawing force is applied, the contact failure is not generated, but the contact reliability is improved. Even if the variation in contact height between the adjacent connecting terminals is generated by the variations in component accuracy and assembly accuracy, one end portion of the manipulation contact piece and one end portion of the support contact piece can be elastically deformed. Therefore, the variations can be absorbed to improve the contact reliability. Unlike the conventional technique, it is not necessary that the insertion hole be made in the base to fix one end portion of the insertion portion of the connecting terminal, so that the width of the base can be decreased to obtain the connector having the small floor area. Particularly, unlike the conventional technique, it is not necessary that the surroundings of the insertion hole be formed thick, so that the low-profile connector can be obtained. In one or more embodiments of the invention, the latching pawl formed in the other end portion of the support contact piece of the connecting terminal is engaged with the edge portion of the base, and only the upper-end and lower-end surfaces of the bending portion are brought into pressure-contact with the upper and lower surfaces of the insertion hole, whereby the connecting terminal is supported by the base. Therefore, the connecting terminal can be supported with predetermined support strength, and the assembly can be achieved with high accuracy. This enables the assembly accuracy to be improved to obtain the connector having no variation in operating characteristics.

In one or more embodiments of the invention, a connector in which H-shape connecting terminals including support contact pieces and manipulation contact pieces are laterally inserted in insertion holes of a base, the insertion holes being made in parallel at predetermined pitches, the support contact piece and the manipulation contact piece being coupled by a coupling portion, a latching pawl is latched in an edge portion of the base, the latching pawl being formed in the other end portion of the support contact piece located on a lower side of the connecting terminal, a flexible board is inserted from an opening on one side of the base, a manipulation lever rotatably attached to a bearing portion of the support contact piece disposed on the other side of the base is manipulated to manipulate the other end portion of the manipulation contact piece formed on an upper side of the connecting terminal, and thereby bringing one end portion of the manipulation contact piece into pressure-contact with the flexible board, wherein at least one bending portion is formed in the support contact piece of the connecting terminal so as to be laterally projected toward a direction orthogonal to an insertion direction, and a projected surface of the bending portion is brought into pressure-contact with and supported by an inside surface of the insertion hole.

According to one or more embodiments of the invention, because one end portion of the support contact piece located on the lower side of the connecting terminal constitutes a free end, one end portion of the manipulation contact piece and one end portion of the support contact piece can elastically be deformed to improve the following capability for FPC. As a result, even if the inadvertent drawing force is applied, the contact failure is not generated, but the contact reliability is improved. Unlike the conventional technique, it is not necessary that the insertion hole be made in the base to fix one end portion of the insertion portion of the connecting terminal, so that the width of the base can be decreased to obtain the connector having the small floor area. Particularly, unlike the conventional technique, it is not necessary that the surroundings of the insertion hole be formed thick, so that the low-profile connector can be obtained. In one or more embodiments of the invention, the latching pawl formed in the other end portion of the support contact piece of the connecting terminal is engaged with the edge portion of the base, and the projected surface of the bending portion is brought into pressure-contact with the inside surface of the insertion hole, whereby the connecting terminal is supported by the base. Therefore, the connecting terminal can be supported with predetermined support strength, and the assembly can be achieved with high accuracy. This enables the assembly accuracy to be improved to obtain the connector having no variation in operating characteristics.

Further, in a connector according to one or more embodiments of the invention, projections are provided in upper-end and lower-end surfaces of the bending portion, the projection being brought into pressure-contact with at least one of upper and lower surfaces of the insertion hole. Accordingly, the support strength is further increased because the bending portion is supported in the insertion hole by not only the projected surface but also the projection provided in the lower-end surface.

Further, in a connector according to one or more embodiments of the invention, a runout portion is formed in at least one of the upper-end and lower-end surfaces of the bending portion. Accordingly, even if the ejection forming is performed to form the bending portion, no bulge is generated in the upper-end and lower-end surfaces of the bending portion, so that the connecting terminal can be produced with high accuracy.

Further, in a connector according to one or more embodiments of the invention, the bending portion is formed in a base portion on a free end side in base portions on both end sides of the coupling portion of the support contact piece. Accordingly, the connector having the aforementioned effect can be obtained.

Further, in a connector according to one or more embodiments of the invention, the bending portion is formed between the coupling portion and the bearing portion of the connecting terminal. Accordingly, in the connecting the connector to FPC, the vicinity of the coupling portion on which an uplift force acts is surely fixed to the base while the bending portion is interposed. Therefore, a slider manipulation force does not escape, but a contact force can be ensured to improve the contact reliability. The operation of the slider is stabilized because the bearing portion which constitutes a rotating support of the slider is disposed between the bending portion of the connecting terminal and the edge portion of the base to which the connecting terminal is fixed. Therefore, a displacement amount of the contact of the connecting terminal is stabilized to stabilize the contact force to FPC, so that contact reliability can be enhanced. Additionally, a half (substantial C-shape) on the right side of the connecting terminal can be rotated about the base portion located between the bending portion and the coupling portion to follow FPC, so that the contact reliability can further be improved.

DETAILED DESCRIPTION OF THE PREFERRED EMBODIMENTS

Figure 1A:
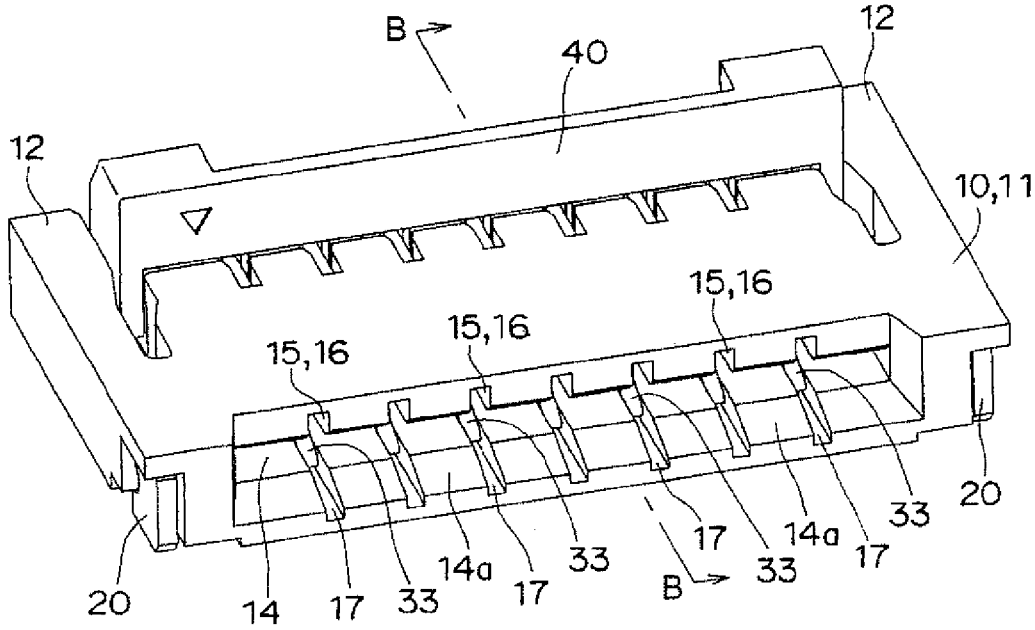
FIGS. 1A and 1B show a perspective view and a longitudinal sectional view of a connector according to an embodiment of the invention respectively.
Figure 1B:
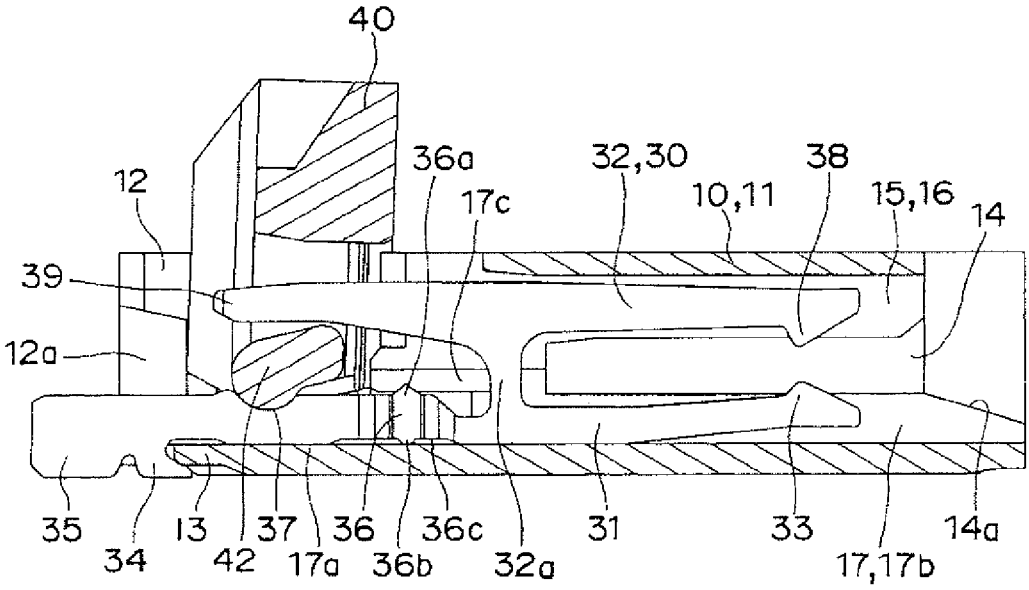
Figure 2:
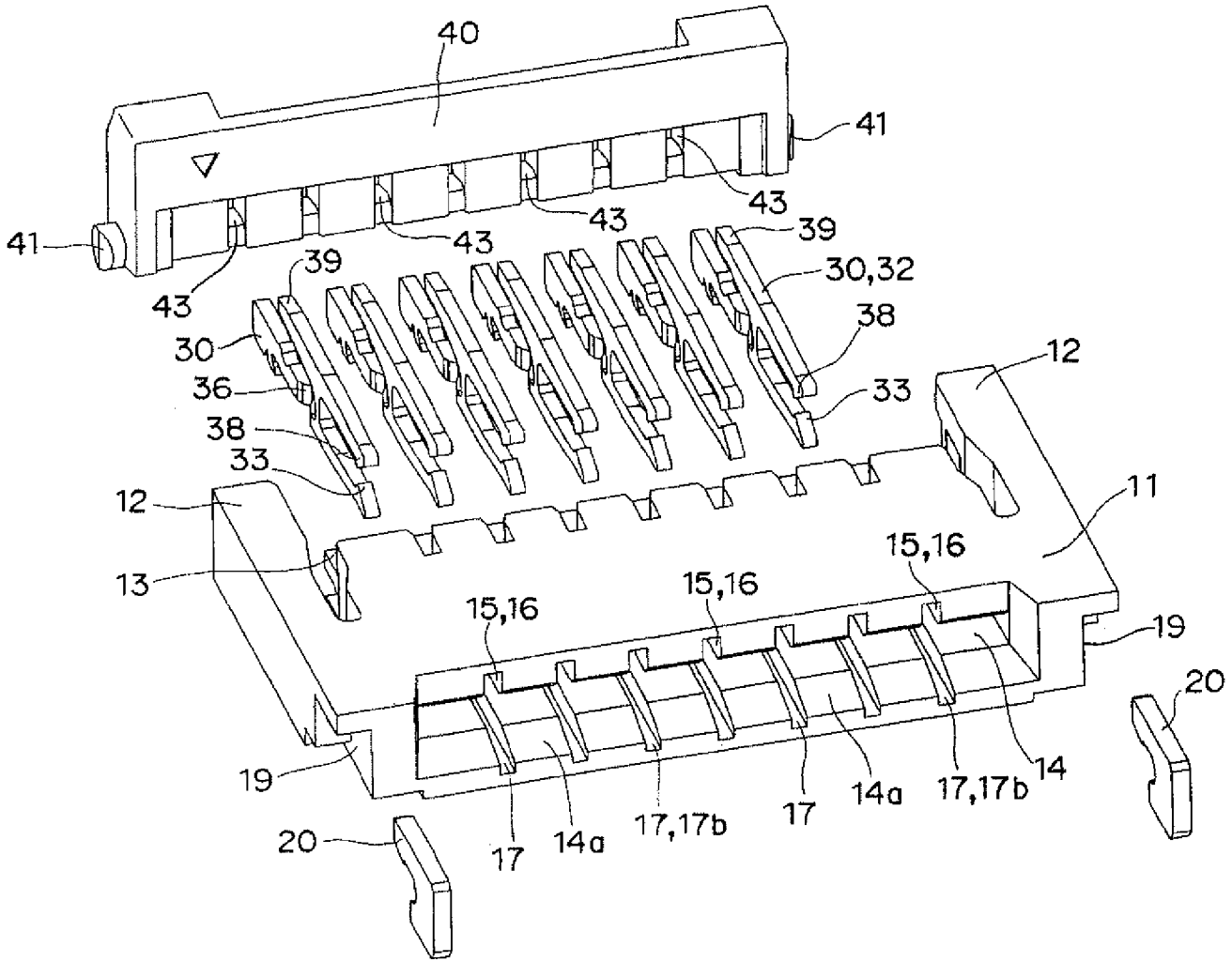
FIG. 2 shows an exploded perspective view of the connector of FIG. 1A.
Figure 3:
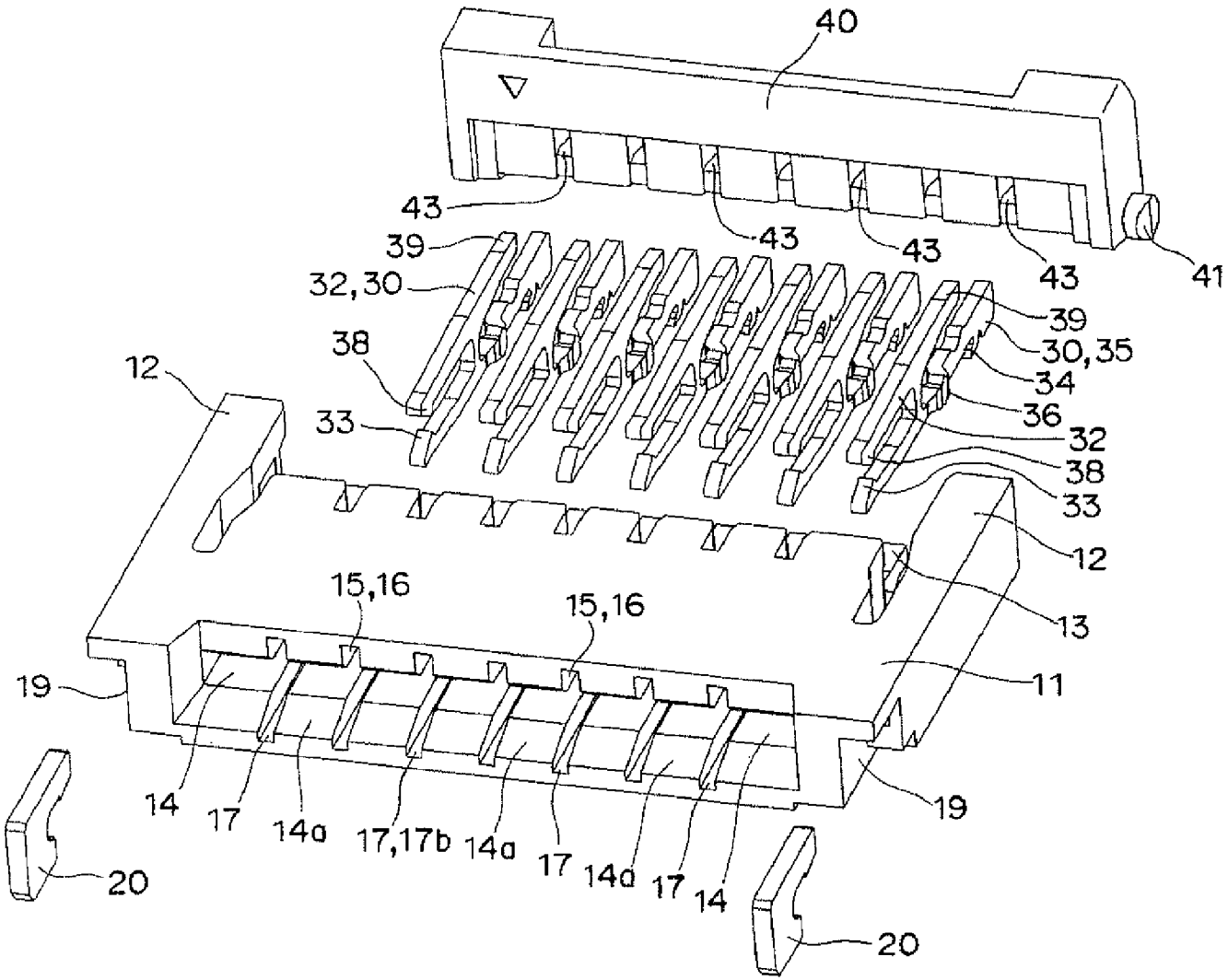
FIG. 3 shows an exploded perspective view of the connector of FIG. 1A when viewed from a different angle.

An embodiment of the invention will be described below with reference to the accompanying drawings. As shown in FIGS. 1 to 3, a connector 10 according to a first embodiment of the invention mainly includes a base 11, reinforcing fittings 20, connecting terminals 30, and a manipulation lever 40.

Figure 6A:
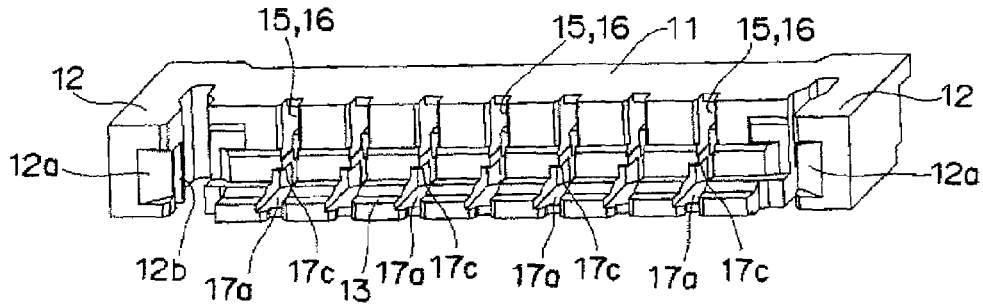
FIGS. 6A to 6C show perspective view of a base of FIG. 1 when viewed from different angles.
Figure 6B:
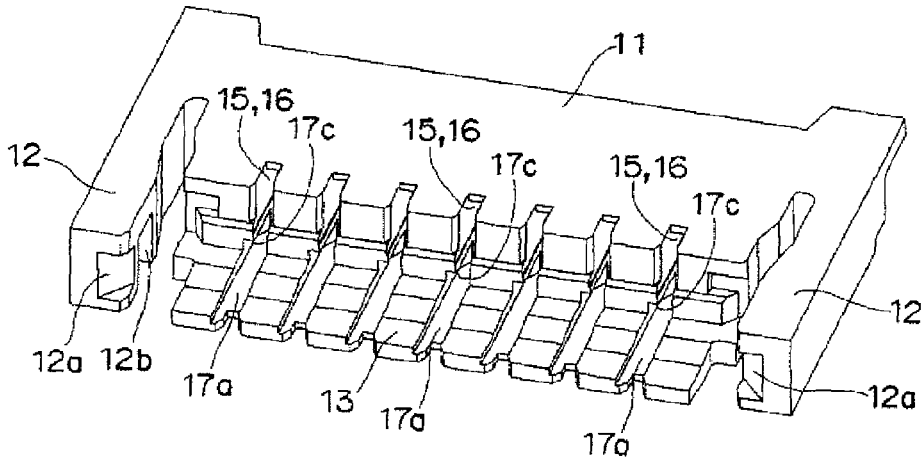
Figure 6C:
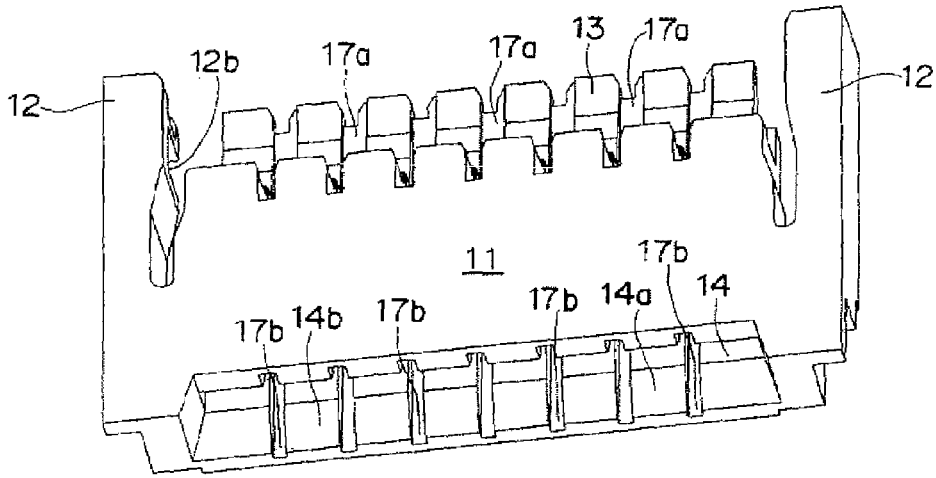
Figure 7A:
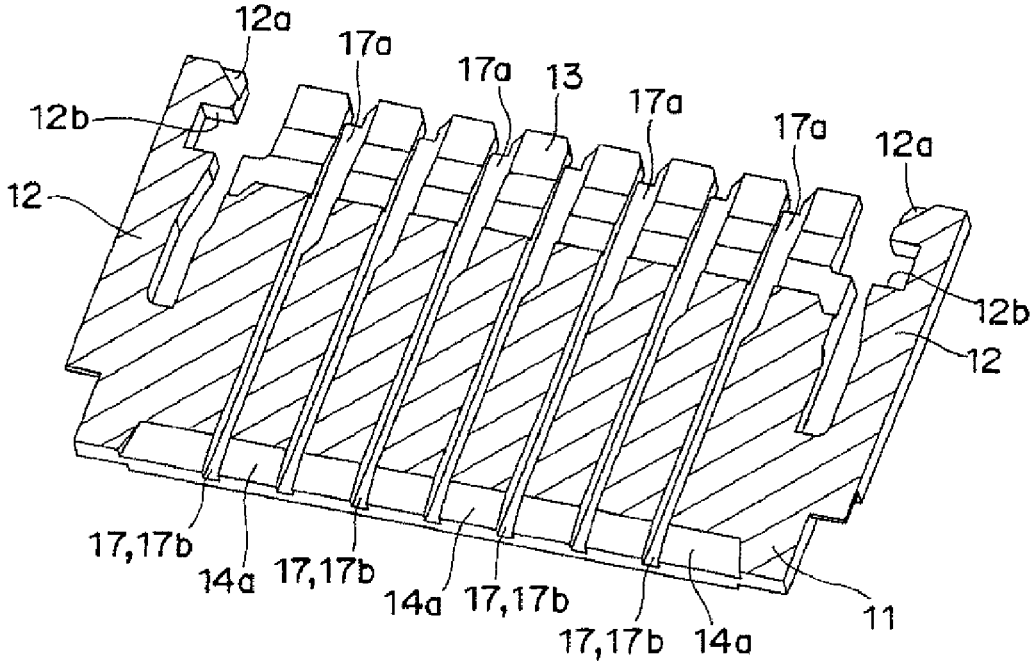
FIGS. 7A and 7B show transverse sectional views of the base of FIG. 6.

As shown in FIG. 6, in the base 11, elastic arm portions 12 and 12 are extended in parallel toward a backside from one-side edge portions in end faces on both sides, and a guide plate 13 is laterally projected from a lower edge portion of the backside. In an inward surface of the elastic arm portion 12, a guiding tapered surface 12*a* is formed in a front-end edge portion and a bearing notch 12*b* is formed at the back of the guiding tapered surface 12*a*. In the base 11, an opening 14 in which a front-end portion 51 of FPC 50 can be inserted is provided in a front surface. A guiding tapered surface 14*a* is formed in a lower-side edge portion of the opening 14. In the base 11, plural insertion holes 15 piercing from the front surface to the backside are made in parallel at predetermined pitches. As shown in FIG. 1B, the insertion hole 15 includes an upper groove portion 16 and a lower groove portion 17. As shown in FIG. 7A, the lower groove portion 17 includes a wide portion 17*a* and a narrow portion 17*b*. One end side of the wide portion 17*a* is extended to an upper surface of the guide plate 13, a stick-out portion 17*c* which engages a stick-out portion 17*c* is formed in the other end portion of the wide portion 17*a* (FIG. 6).

As shown in FIGS. 2 and 3, the reinforcing fittings 20 and 20 are used to prevent uplift and peel-off of the connector 10 in the case where the connector 10 is mounted on a printed board (not shown), and the reinforcing fittings 20 and 20 are fixed by engaging notches 19 and 19 provided in front-surface side edge portions in both side faces of the base 11.

Figure 8A:
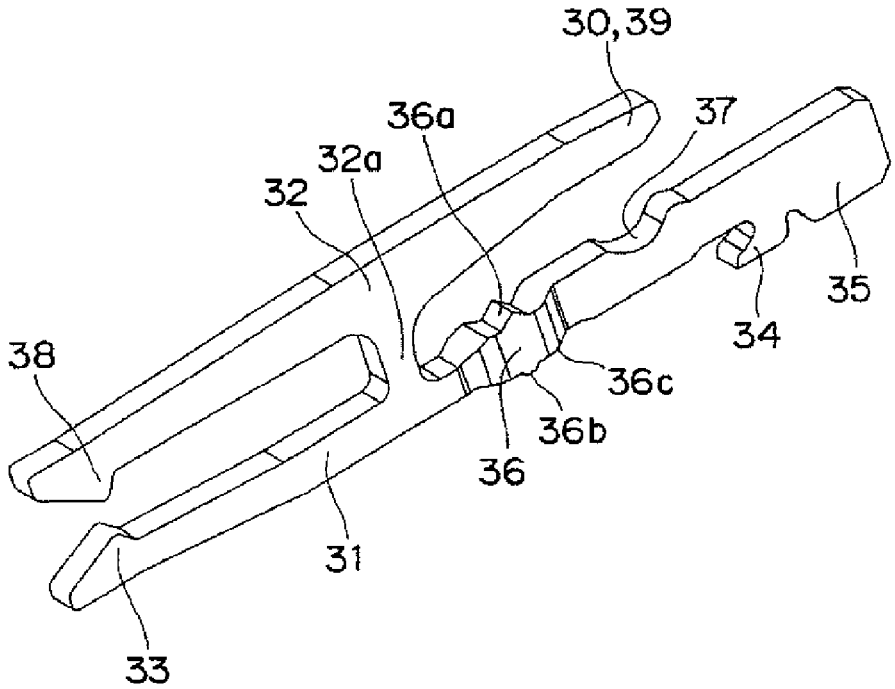
FIGS. 8A and 8B show perspective views illustrating a connecting terminal of FIGS. 2 and 3 when viewed from different angles.
Figure 8B:
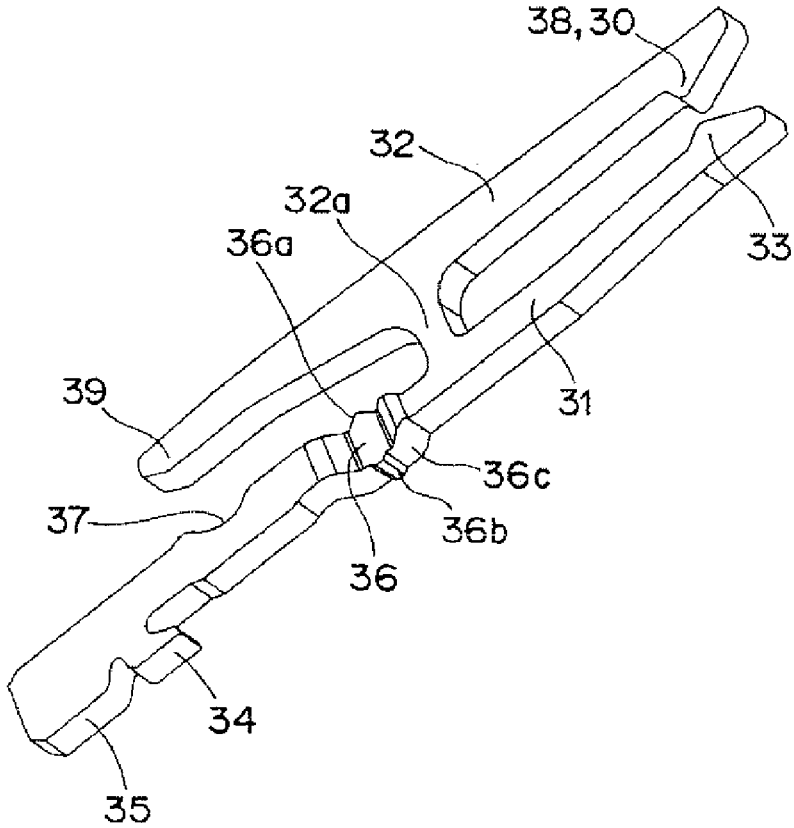

As shown in FIG. 8, the connecting terminal 30 includes a support contact piece 31 and a manipulation contact piece 32. The support contact piece 31 is inserted in and fixed to the lower groove portion 17 of the base 11. The manipulation contact piece 32 is connected to the support contact piece 31 by a coupling portion 32*a* extended from a substantial center of the support contact piece 31. In the support contact piece 31, a first contact 33 is projected upward in one end portion, and a latching pawl 34 and a terminal portion 35 are formed in a lower edge portion on the other end portion side. In the support contact piece 31, a bending portion 36 is formed near base portion of the coupling portion 32*a*. The bending portion 36 is bent by performing protrusion in a thickness direction. In the bending portion 36, a latching projection 36*a* is projected from the upper-end surface, and a pressure-contact projection 36*b* is provided in the center of a runout portion 36*c* provided in the lower-end surface. In the upper-end surface of the support contact piece 31, a bearing portion 37 is formed between the latching pawl 34 and the bending portion 36. The bearing portion 37 rotatably supports a manipulating cam portion 42 of the manipulation lever 40. On the other hand, in the manipulation contact piece 32, a second contact 38 is projected downward in one end portion, and a manipulation support 39 is formed in the other end portion.

Figure 9A:
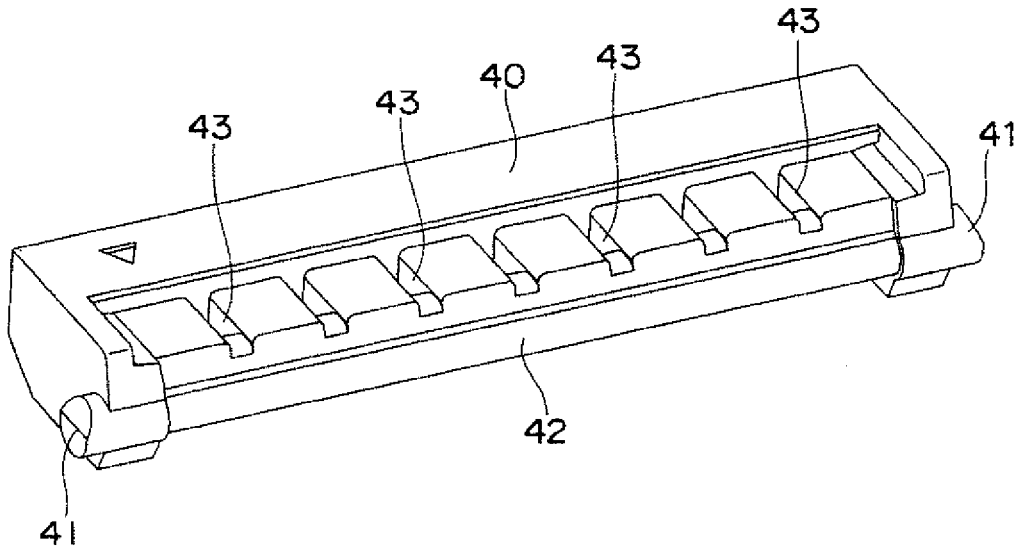
FIGS. 9A and 9B show perspective views illustrating a manipulation lever of FIGS. 2 and 3 when viewed from different angles.
Figure 9B:
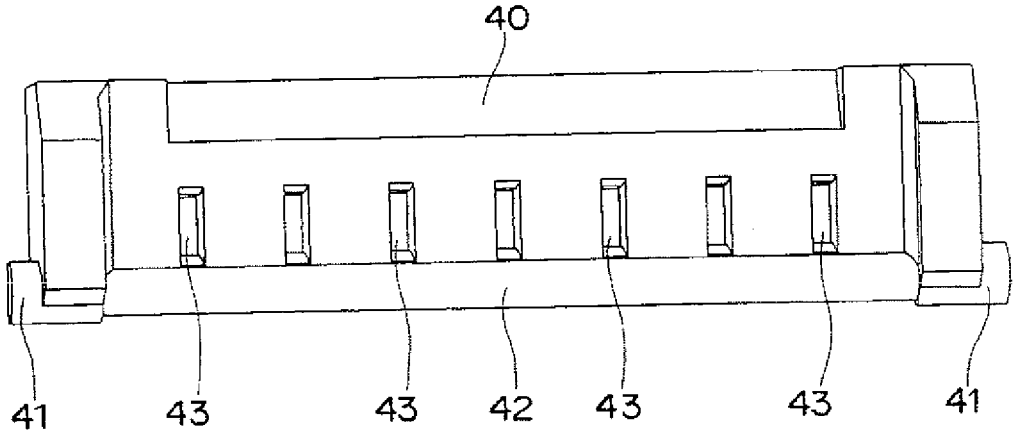

As shown in FIG. 9, in the manipulation lever 40, rotary shaft portions 41 and 41 are projected in end faces on both sides while being coaxial with each other, and the manipulating cam portion 42 is provided between the rotary shaft portions 41 and 41 in order to manipulate the manipulation contact piece 32 of the connecting terminal 30. Through holes 43 are made at the back of the manipulating cam portion 42, and the manipulation support 34 of the connecting terminal 30 is inserted in the through hole 43.

Figure 10A:
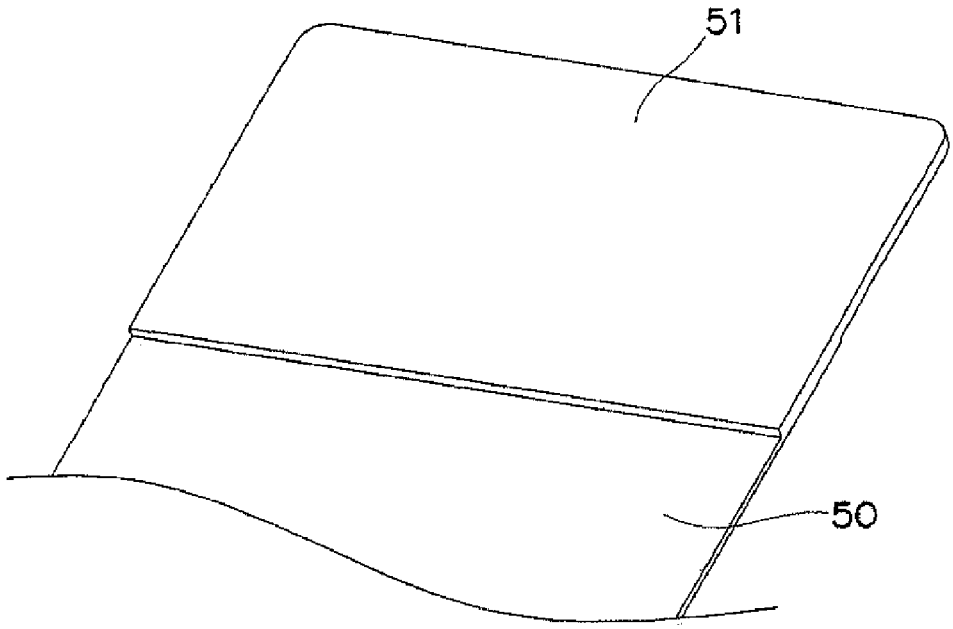
FIGS. 10A and 10B show perspective views illustrating the connector when viewed from different angles.
Figure 10B:
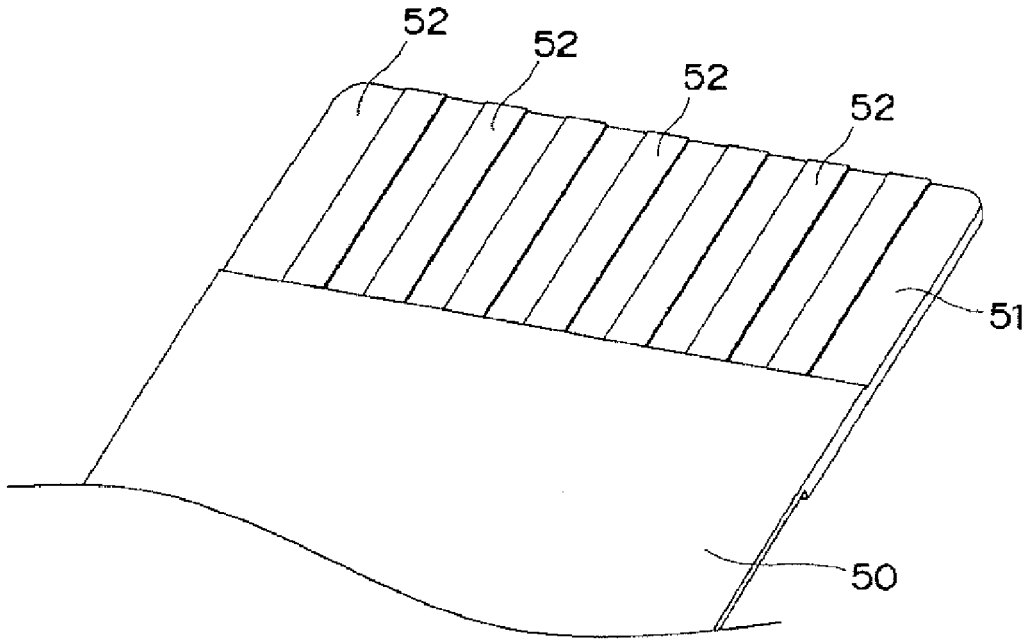

As shown in FIG. 10, in FPC 50 connected to the connector 10 of the embodiment, connecting portions 52 are provided in parallel at predetermined pitches. In the connecting portion 52, printed wiring is formed in a lower surface of a front-end portion 51.

A method for assembling components will be described below. As shown in FIGS. 2 and 3, the support contact piece 31 of the connecting terminal 30 provided in the guide plate 13 of the base 11 is slid from the backside of the base 11 and inserted in the connecting terminal 30 of the insertion hole 15. Therefore, the projected surface of the bending portion 36 of the connecting terminal 30 is brought into pressure-contact with the inside surface of the wide portion 17*a*. The connecting terminal 30 is pushed in, thereby latching the latching projection 36*a* of the bending portion 36 in the ceiling surface of the stick-out portion 17*c* while bringing the pressure-contact projection 36*b* pressure-contact with the bottom surface of the lower groove portion 17. The latching pawl 34 of the connecting terminal 30 is latched in the edge portion of the guide plate 13 and positioned at a predetermined position. The reinforcing fitting 20 is engaged with and fixed to the notch 19 of the base 11.

When the rotary shaft portions 41 of the manipulation lever 40 are press-fitted along the guiding tapered surfaces 12*b* of the elastic arm portions 12 and 12, the elastic arm portions 12 and 12 are elastically deformed outward. Therefore, while the shaft portions 41 are fitted in the bearing notches 12*b*, the manipulating cam portion 42 of the manipulation lever 40 is rotatably supported on the bearing portions 37, and the assembling work is completed.

Figure 4A:
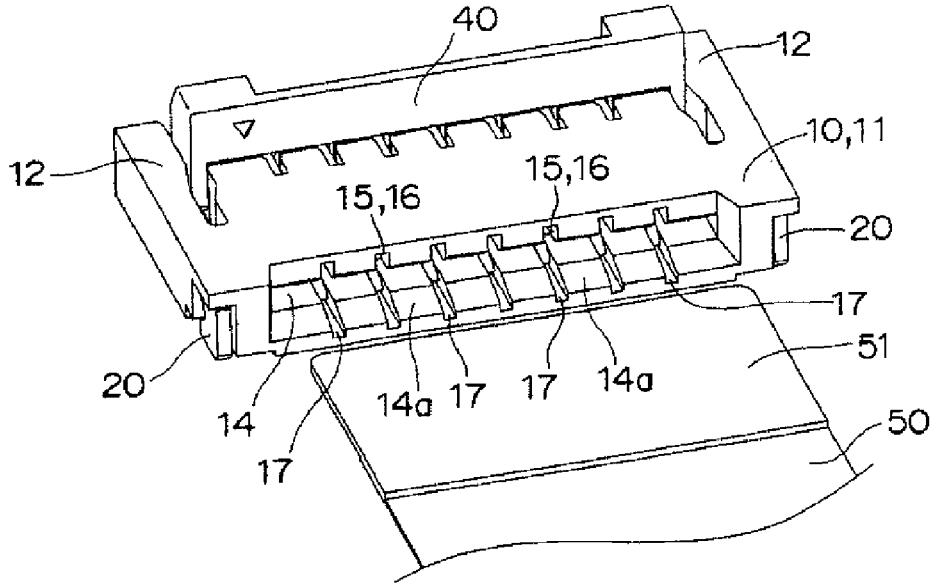
FIGS. 4A and 4B show perspective views illustrating states before and after a front-end portion of FPC is inserted in the connector of the embodiment.
Figure 4B:
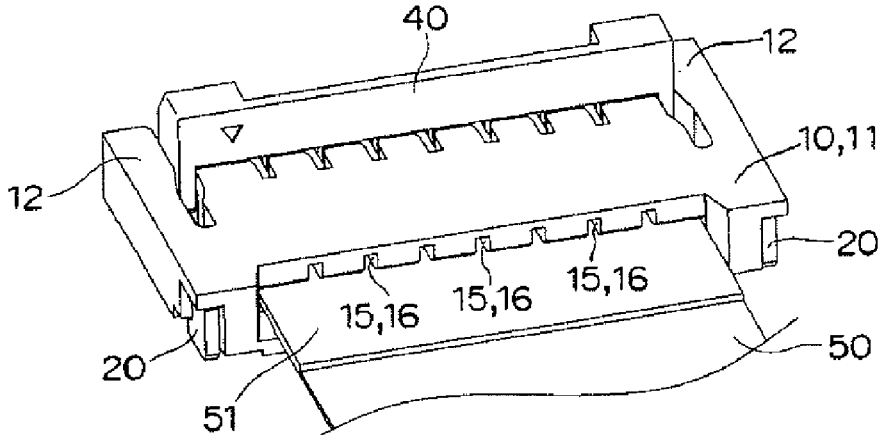
Figure 4C:
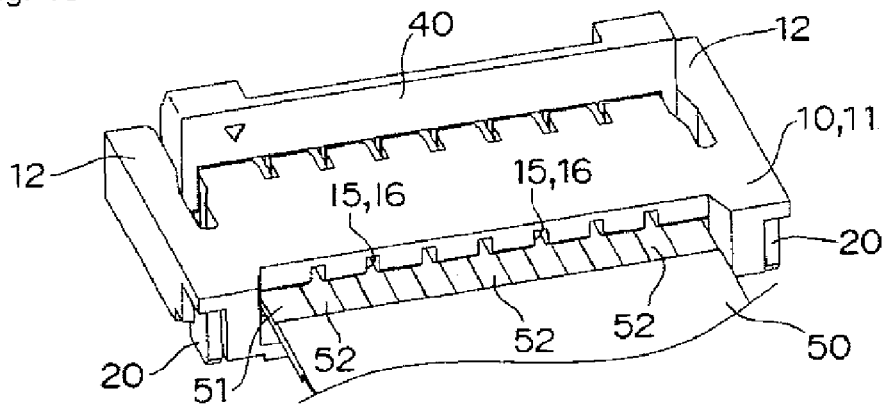
FIG. 4C shows a perspective view illustrating a state after FPC is connected to the connector while facing down.
Figure 5A:
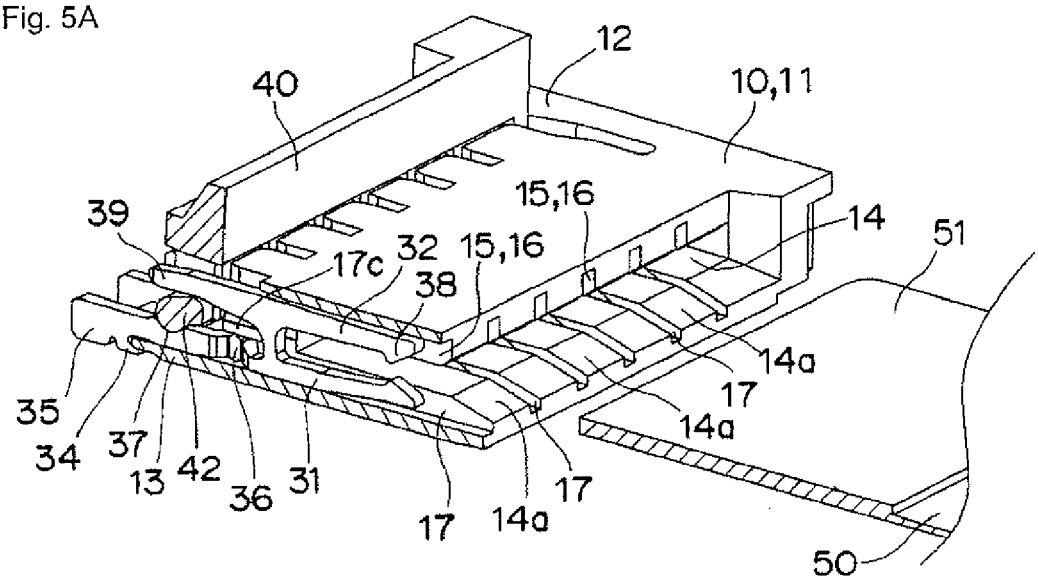
FIGS. 5A to 5C show perspective views explaining a method for attaching FPC to the connector of the embodiment.
Figure 5B:
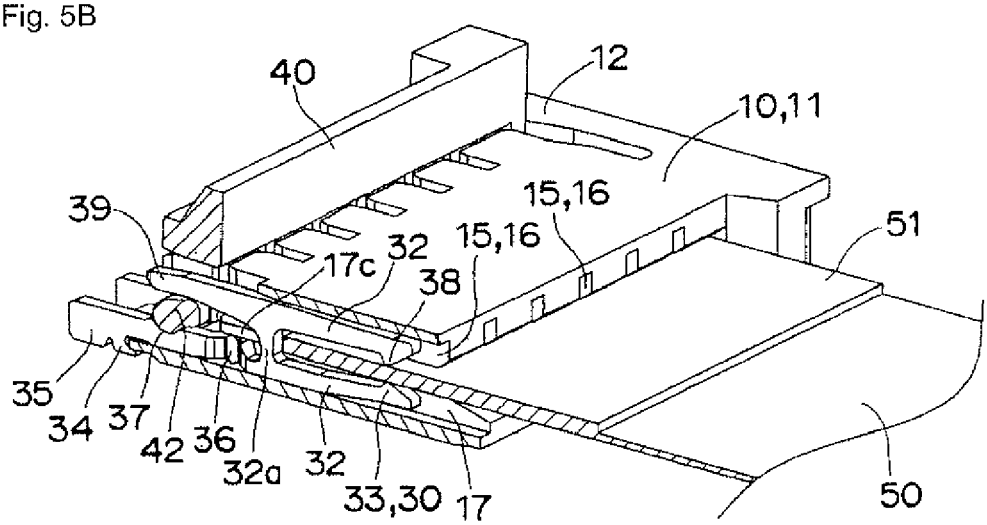
Figure 5C:
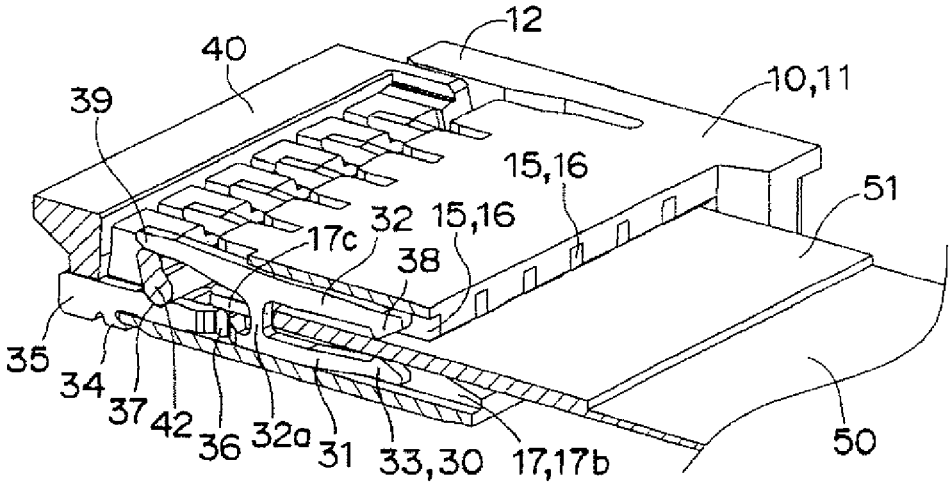

A method for connecting and fixing FPC 50 to the connector 10 will be described below. As shown in FIGS. 4 and 5, the front-end portion 51 of FPC 50 is inserted from the opening 14 of the base 11 until abutting on the inside surface of the base 11. When the manipulation lever 40 is forced down about a shaft center of the rotary shaft portion 41, the manipulating cam portion 42 of the manipulation lever 40 is rotated to push up the manipulation support 39 of the connecting terminal 30. Therefore, the manipulation contact piece 32 is inclined, and The second contact 38 pushes down the upper surface of the front-end portion 51 of FPC 50, so that the first contact 33 of the connecting terminal 30 is electrically connected to the connecting portion 52 of FPC 50. Even if the variation in positioning accuracy of the first and second contacts 33 and 38 is generated by the variations in component accuracy and assembly accuracy, the half (substantial C-shape) on the right side of the connecting terminal 30 shown in FIG. 1B can be rotated about the base portion located between the bending portion 36 and the coupling portion 32*a* to follow FPC 50, so that the high contact reliability can be achieved. In the embodiment, as shown in FIG. 4C, FPC 50 can be connected even if FPC 50 is reversed.

Figure 7B:
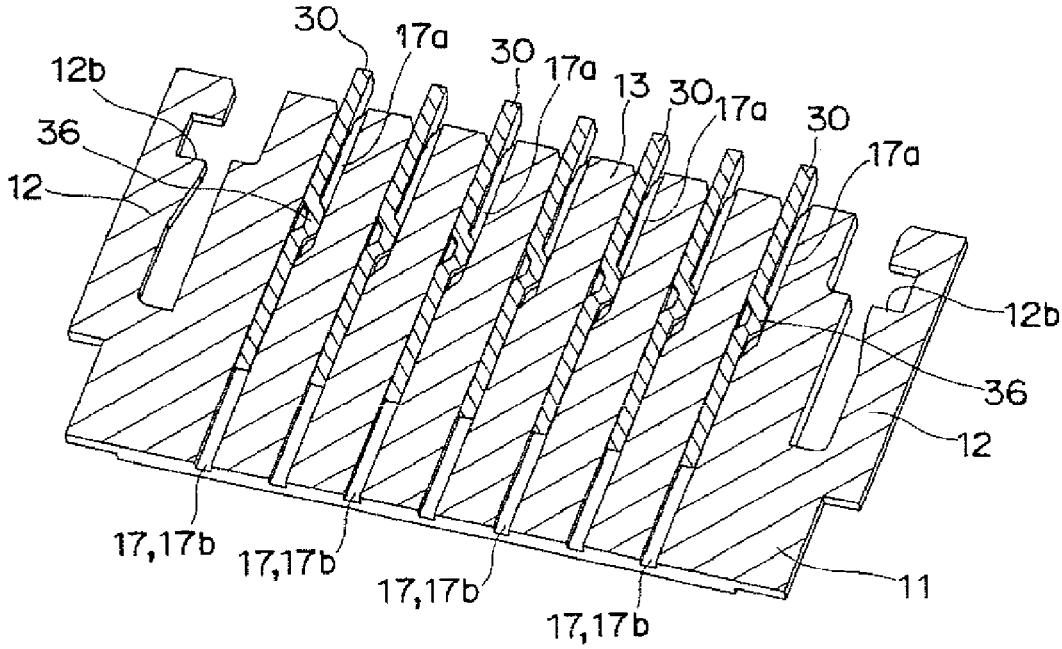

According to the embodiment, as shown in FIG. 7B, the bending portion 36 of the connecting terminal 30 is brought into pressure-contact with the inside surface of the wide portion 17*a* of the lower groove portion 17. As shown in FIG. 1B, the latching projection 36*a* provided in the upper-end surface of the bending portion 36 engages the ceiling surface of the stick-out portion 17*c*, the pressure-contact projection 36*b* provided in the lower-end surface is brought into pressure-contact with the bottom surface of the lower groove portion 17. Therefore, advantageously the connector 10 further hardly drops out.

According to the embodiment, one of the first and second contacts 33 and 38 can follow FPC 50 according to the elastic deformations of the support contact piece 31 and the manipulation contact piece 32, and the high contact reliability is achieved. Because one end portion of the connecting terminal 30 constitutes the free end, it is not necessary that one end portion of the connecting terminal 30 be fixed to the base 11. Therefore, the low-profile connector having the small floor area is advantageously obtained.

The connector of the invention is not limited to the embodiment, but the invention can obviously be applied to other connectors.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A connector comprising:

a base comprising insertion holes in parallel at a predetermined pitch;

H-shape connecting terminals laterally inserted into the insertion holes of the base, each connecting terminal comprising a support contact piece on a lower side of the connecting terminal, a manipulation contact piece on an upper side of the connecting terminal, and a coupling portion which couples the support contact piece and the manipulation contact piece; and a manipulation lever rotatable attached to a bearing portion of the support contact piece disposed on a first side of the base, wherein a latching pawl, formed on a first end of the support contact piece, is latched on an edge portion of the base, wherein a flexible board is inserted from an opening on a second side of the base, wherein the manipulation lever is configured to manipulate the manipulation contact piece to bring an end portion of the manipulation contact piece into pressure-contact with the flexible board, and wherein at least one bending portion is formed in the support contact piece of the connecting terminal so as to be laterally projected toward a direction orthogonal to an insertion direction, and only upper-end and lower-end surfaces of the bending portion are brought into pressure-contact with and supported by upper and lower surfaces of the insertion hole.

2. A connector comprising:

a base comprising insertion holes in parallel at a predetermined pitch;

H-shape connecting terminals laterally inserted into the insertion holes of the base, each connecting terminal comprising a support contact piece on a lower side of the connecting terminal, a manipulation contact piece on an upper side of the connecting terminal, and a coupling portion which couples the support contact piece and the manipulation contact piece; and a manipulation lever rotatably attached to a bearing portion of the support contact piece disposed on a first side of the base, wherein a latching pawl, formed on a first end of the support contact piece, is latched on an edge portion of the base, wherein a flexible board is inserted from an opening on one a second side of the base, wherein the manipulation lever is configured to manipulate the manipulation contact piece to bring an end portion of the manipulation contact piece into pressure-contact with the flexible board, and wherein at least one bending portion is formed in the support contact piece of the connecting terminal so as to be laterally projected toward a direction orthogonal to an insertion direction, and a projected surface of the bending portion is brought into pressure-contact with and supported by an inside surface of the insertion hole.

3. The connector according to claim 2, wherein projections are provided in upper-end and lower-end surfaces of the bending portion, the projection being brought into pressure-contact with at least one of upper and lower surfaces of the insertion hole.

4. The connector according to claim 1, wherein a runout portion is formed in at least one of the upper-end and lower-end surfaces of the bending portion.

5. The connector according to claim 1, wherein the bending portion is formed in a base portion on a free end side in base portions on both end sides of the coupling portion of the support contact piece.

6. The connector according to claim 1, wherein the bending portion is formed between the coupling portion and the bearing portion of the connecting terminal.

7. The connector according to claim 2, wherein a runout portion is formed in at least one of the upper-end and lower-end surfaces of the bending portion.

8. The connector according to claim 3, wherein a runout portion is formed in at least one of the upper-end and lower-end surfaces of the bending portion.

9. The connector according to claim 2, wherein the bending portion is formed in a base portion on a free end side in base portions on both end sides of the coupling portion of the support contact piece.

10. The connector according to claim 3, wherein the bending portion is formed in a base portion on a free end side in base portions on both end sides of the coupling portion of the support contact piece.

11. The connector according to claim 2, wherein the bending portion is formed between the coupling portion and the bearing portion of the connecting terminal.

12. The connector according to claim 3, wherein the bending portion is formed between the coupling portion and the bearing portion of the connecting terminal.

* * * * *